US012448767B2

(12) United States Patent
Monson et al.

(10) Patent No.: US 12,448,767 B2
(45) Date of Patent: Oct. 21, 2025

(54) BUFFER BOX OF A VACUUM DRAINAGE SYSTEM

(71) Applicant: EVAC OY, Espoo (FI)

(72) Inventors: Timothy W. Monson, Winnebago, IL (US); Matthew A. Wales, Beloit, WI (US)

(73) Assignee: EVAC OY, Espoo (FI)

( * ) Notice: Subject to any disclaimer, the term of this patent is extended or adjusted under 35 U.S.C. 154(b) by 8 days.

(21) Appl. No.: 18/277,160

(22) PCT Filed: Feb. 24, 2022

(86) PCT No.: PCT/FI2022/050122

§ 371 (c)(1),
(2) Date: Aug. 14, 2023

(87) PCT Pub. No.: WO2022/180308

PCT Pub. Date: Sep. 1, 2022

(65) Prior Publication Data

US 2024/0133172 A1 Apr. 25, 2024
US 2024/0229442 A9 Jul. 11, 2024

Related U.S. Application Data

(60) Provisional application No. 63/153,976, filed on Feb. 26, 2021.

(51) Int. Cl.
*E03F 1/00* (2006.01)

(52) U.S. Cl.
CPC ..... *E03F 1/006* (2013.01)

(58) Field of Classification Search
CPC ..... E03F 1/006; E03F 5/16; B01D 17/0211
See application file for complete search history.

(56) References Cited

U.S. PATENT DOCUMENTS 5,421,040 A * 6/1995 Oldfelt ..... E03D 11/08 4/435
6,305,403 B1 10/2001 von Palffy et al.
(Continued)

FOREIGN PATENT DOCUMENTS

CA 2305897 A1 10/2000
CA 3016816 A1 3/2019
JP 2001107443 A 4/2001

OTHER PUBLICATIONS

Japanese Office Action related to Application No. 2023-548298; reported on Sep. 3, 2024.
(Continued)

*Primary Examiner* — Reinaldo Sanchez-Medina
(74) *Attorney, Agent, or Firm* — von Briesen & Roper, s.c.

(57) ABSTRACT

The invention relates to a buffer box of a vacuum drainage system, which vacuum drainage system comprises the buffer box, which buffer box comprises as an outer frame structure side walls, end walls, a top wall and a bottom wall and which buffer box further comprises at least one inlet and an outlet, a vacuum drainage piping, at least one collection branch connected to the vacuum drainage system and to the outlet of the buffer box, wherein each of the collection branches comprises a suction valve, a pump connected to the vacuum drainage piping and configured to create negative pressure in the vacuum drainage piping. The buffer box comprises at least two compartments, which comprise a main compartment and a suction compartment with a suction outlet. Between the main compartment and the suction compartment a baffle is located. The baffle extends from the top wall towards the bottom wall and is located at a distance from the bottom wall such that a baffle opening is formed between the main compartment and the suction compartment. The baffle
(Continued)

is configured to prevent the air on top of the liquid in the main compartment to enter the suction compartment.

11 Claims, 4 Drawing Sheets

(56) References Cited

U.S. PATENT DOCUMENTS

| | | | | |
|---|---|---|---|---|
| 6,467,497 | B1 | 10/2002 | Stradinger et al. | |
| 7,374,669 | B2 * | 5/2008 | Zinn | E03F 1/006 210/138 |
| 7,951,294 | B2 * | 5/2011 | Duran | B01D 21/0006 210/170.03 |
| 2015/0076057 | A1 * | 3/2015 | MacDougall | F24F 13/222 210/601 |
| 2019/0071852 | A1 | 3/2019 | Zinn et al. | |
| 2020/0080764 | A1 | 3/2020 | Skomsøy et al. | |

OTHER PUBLICATIONS

International Search Report and Written Opinion for related Application No. PCT/FI2022/050122; report dated May 27, 2022.
Finnish Communication of Acceptance for related Application No. 20215241; reported dated Sep. 21, 2021.

* cited by examiner

BUFFER BOX OF A VACUUM DRAINAGE SYSTEM

TECHNICAL FIELD

The invention relates in general to vacuum drainage systems. Especially the invention relates to a buffer box of a vacuum drainage system according to the preamble part of the independent claim 1.

BACKGROUND

It is known from prior art that in grocery stores, supermarkets etc. and for institutional catering services, for example for schools, canteens, cafeterias, temperature controlled cabinets for cool temperatures i.e. temperatures typically below +8° C. are employed for products, such as food stuffs, beverages and like that must be kept in cooled temperatures and to allow users or customers to access groceries and other refrigerated or frozen items from the cabinet. These cabinets typically comprise a frame structure; supporting, top, bottom and wall structures with at least one door or without the doors with at least one partially open wall for customers to access the products. The frame structure surrounds at least one product space, which comprises shelves and/or other structures for the refrigerated or frozen products. It is known from prior art that as part of the bottom structure a base structure forming a reservoir is used. The reservoir is used to collect any condensate moisture controllably and typically provided with drainage means for removing the condensate moisture. The drainage means typically comprise piping for removing the collected condensate moisture from the reservoir. It is also known to locate the reservoir for collecting the condensate moisture as a separate structure from the cabinet in space left between the floor of the room, in which the cabinet is located, and the bottom wall of the cabinet. It is known from the prior art vacuum drainage systems are used as drainage means for removing the condensate moisture.

In international patent application publication WO 2018/174719 A1 is disclosed a system for accumulation and evacuation of defrosting condensation water from a refrigeration and cooling unit under, in which each of water evacuation units includes a docking station and a water collection tray to be slidably provided within the docking station, whereby each unit is custom made to fit between the refrigeration unit and a floor where the refrigeration unit is placed, and whereby which docking station includes upwardly protruding guide members and end stoppers for guiding and positioning of the tray within the docking station, at the end of the docking station, between the end stoppers, is provided a suction pipe connection to be sealingly connected at its outer end to vertical piping of the system.

In U.S. Pat. No. 6,467,497 B1 is disclosed a buffer box for use in a vacuum collection system having a drainage pipe maintained under partial vacuum pressure, a suction valve for selectively controlling access to the drainage pipe, and a collection pipe having an inlet adapted to collect waste fluid from a waste fluid source. The buffer box comprises a base, a side wall extending upwardly from the base, a cover attached to the side wall so that an interior of the base, side wall, and cover define a reservoir, an inlet fluidly communicating between the collection pipe and the reservoir, an outlet formed in the side wall adapted to fluidly communicate with the suction valve, and an air intake orifice integrally provided with the buffer box and fluidly communicating between the reservoir and atmosphere, wherein waste fluid collecting in the reservoir is transported to the drainage pipe when the suction valve actuates to an open position. By this buffer box effective transport of condensation water in the vacuum drainage system is accomplished. This buffer box is designed to contain and transport a measured amount of water using a pneumatic head pressure sensing port. The pressure head sensing port is connected to a pneumatic activator the that connects the vacuum source to a discharge valve that opens to remove the contents of the buffer box.

During the recent times due to redesigns of the temperature controlled cabinet for low temperatures height of the space left between the floor of the room, in which the temperature controlled cabinet for low temperatures is located, and the bottom wall of the cabinet has decreased and thus there exist a need to redesign the reservoirs for collecting the condensate moisture with decreased height as in some instances a recess in the floor to accommodate the reservoir has been needed to provide or in some other instances a supplementary pumping system to collect the condensate and transport it to the reservoir, now located elsewhere for example located on top of the cabinet, has been needed to be provided in order to interface with the vacuum drainage system.

The decreased height of the buffer box may cause a disadvantage due to the air accumulation over the top of the fluid, of which most will simply travel over the top of the fluid on its way to the buffer box outlet to the riser of the vacuum drainage system. This might further cause difficulties in functioning of the vacuum drainage system, especially in removal functions of the buffer box.

One object of the invention is to eliminate or at least minimize the above problems and disadvantages of prior art buffer boxes for vacuum drainage systems.

A particular object of the invention is to create a buffer box with decreased height, in which the disadvantages and problems relating to the air accumulation over the top of the fluid are eliminated or at least minimized.

SUMMARY

To achieve the above-mentioned objects and those which come out later, the buffer box of a vacuum drainage system according to the invention is mainly characterized by what is presented in the characterizing part of claim 1. Advantageous features of the invention are defined in dependent claims.

According to the invention the buffer box of a vacuum drainage system comprising the buffer box comprising as an outer frame structure side walls, end walls, a top wall and a bottom wall and further comprising an inlet and an outlet, which vacuum drainage system comprises a vacuum drainage piping, at least one collection branch connected to the vacuum drainage system and to the outlet of the buffer box, wherein each of the collection branches comprises a suction valve, a pump connected to the vacuum drainage piping and configured to create negative pressure in the vacuum drainage piping, wherein the buffer box comprises a main compartment and a suction compartment with a suction outlet, wherein between the main compartment and the suction compartment a baffle is located, wherein the baffle extends from the top wall towards the bottom wall and is located at a distance from the bottom wall such that a baffle opening is formed between the main compartment and the suction compartment and wherein the baffle is configured to prevent the air on top of the liquid in the main compartment to enter the suction compartment. According to an advantageous aspect of the invention the vacuum drainage system comprises a storage tank and the vacuum drainage piping is connected to the storage tank or according to another advantageous aspect the vacuum drainage system comprises a pump and the vacuum drainage piping is via the pump directly connected to a vacuum transport plumbing or directly to a drain to a sewer.

According to an advantageous feature of the invention the buffer box is low, wherein the height of the buffer box is sufficient to receive drainage as positioned underneath the temperature controlled cabinet, typically 50 mm or less, as dependent on the clearance from ground level to the drain of the temperature controlled cabinet.

According to an advantageous feature of the invention the suction compartment comprises a pre-aeration port configured to allow a measured amount of air to the outlet prior to liquid from the main compartment of the buffer box.

According to an advantageous feature of the invention the suction compartment is configured to accelerate emptying of the main compartment from therein collected liquid by removing air from the suction compartment through the pre-aeration port by creating a vacuum in the suction compartment by providing a suction force along the baffle opening from the main compartment to the suction compartment.

According to an advantageous feature of the invention area of the baffle opening exists in direct proportion to the flow area of the buffer box outlet and width of the buffer box, advantageously the area of the baffle opening is at a minimum 1:1 proportion to the box outlet. By this, the possible restriction of the flow is advantageously avoided.

According to an advantageous feature of the invention the buffer box comprises a pneumatic head pressure chamber. According to an advantageous aspect the flow from the main compartment to the suction compartment in the buffer box is configured to keep the pneumatic head pressure chamber free of debris by designing the height of the baffle opening as determined by the area of flow of the outlet and width of the buffer box is equivalent to the set height of the opening of the pneumatic head pressure chamber. By this relationship is advantageously ensured that as the fluid flows under the baffle, the velocity of the flow that is produced scours the opening of the pneumatic pressure chamber which is correspondingly set.

According to an advantageous feature of the invention the buffer box is configured to withstand sudden and sustained surge flows proportional to the buffer box capacity and outlet flow area. In one embodiment of the invention with a nominal holding capacity of up to 1 L, the buffer box is configured to withstand a sudden and sustained surge flow of up to 30 LPM without overflowing.

According to an advantageous feature of the invention the buffer box further comprises a suction chamber vent. The vent allows pressure equilibrium during the filling of the box with collected fluid between the main chamber and the suction compartment and subsequently serves to feed air to the pre-aeration port during the evacuation of the suction compartment.

According to an advantageous feature of the invention the buffer box further comprises a head pressure port.

According to an advantageous aspect of the invention the vacuum drainage system comprises a pneumatically activated activator configured to be used with the buffer box. The pneumatically activated activator comprises an activation head of less than 50 mm, advantageously of 12-25 mm nominally.

According to an advantageous aspect of the invention the vacuum drainage system comprises a pre-aeration port configured to allow a measured amount of air into the outlet prior to the water from the main compartment of the buffer box. This aeration rapidly clears standing water from the horizontally from the outlet extending pipe part of the collection branch that connects the buffer box to the vacuum drainage piping. This horizontal pipe part is typically up to 1 meter in length.

According to an advantageous aspect of the invention the buffer box of the vacuum drainage system comprises a suction compartment that accelerates the emptying of the main compartment of the buffer box to efficiently remove surges of water from events such as temperature controlled cabinet washdowns as the air is removed from the suction compartment through the pre-aeration port, a vacuum is created in the suction compartment, which vacuum creates a suction force along the baffle opening from the main compartment to the suction compartment. This produces an accelerated emptying of the main compartment with a reduced air flow into the vacuum drainage system. The flow through the buffer box keeps also the sensing chamber i.e., the pneumatic head pressure chamber free of debris and helps to increase velocity of the flow under the baffle i.e. in the baffle opening to keep the buffer box clean and clear of soft debris.

According to an advantageous aspect of the invention in the vacuum drainage system as the air is removed from the suction compartment through the pre-aeration port, a vacuum is created in the suction compartment. This vacuum creates a suction force along the baffle opening from the main compartment to the suction compartment. This produces an accelerated emptying of the main compartment with a reduced air flow into the vacuum drainage system. This provides for accelerated emptying the water with the reduced air flow into the vacuum drainage system and thus the buffer box is provided to withstand sudden and sustained surge flows of up to 30 LPM without overflowing. Thus, the configuration of the buffer box also allows for a high-flow rinse area around the opening of the pneumatic head pressure chamber and across the bottom of the buffer box. This flow of water across the bottom of the buffer box provides a rinsing action across the bottom of the pneumatic sensing column.

The invention is especially suitable to be used in connection with temperature controlled cabinets for cool temperatures as a condensate collection system. This low-profile sensing and control approach is also adaptable to other collection products such as floor and shower drains which are utilized as gray water collection points for vacuum waste drainage systems.

The buffer box of a vacuum drainage system according to the invention and its advantageous features provides for a reduction in maintenance to the rinsing effect of the pneumatic sensing column. The buffer box also reduces or even eliminates the jelly buildup around the pneumatic pressure sensing port.

BRIEF DESCRIPTION OF THE DRAWINGS

Aspects of the invention, however, together with additional objects and advantages thereof, will be best understood from the following description of some example embodiments when read in connection with the accompanying drawings and in the following the invention is described in more detail referring to the accompanying drawing, in which In FIG. 1 is schematically shown an advantageous example of vacuum drainage system.

DETAILED DESCRIPTION

During the course of this description like numbers and signs will be used to identify like elements according to the different views which illustrate the invention. Repetition of some reference signs may have been omitted in the figures for clarity reasons.

Figure 1:
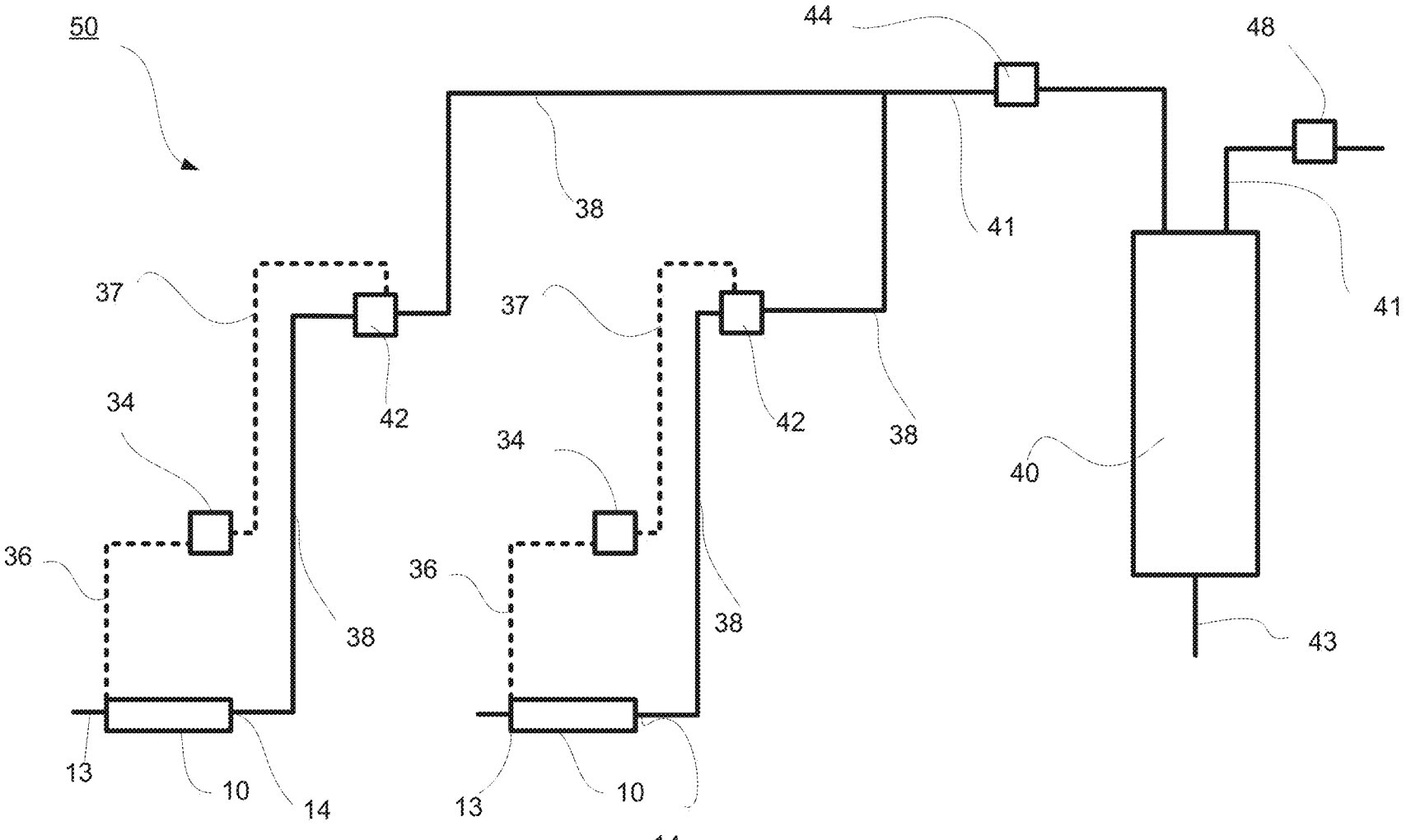
Figure 2A:
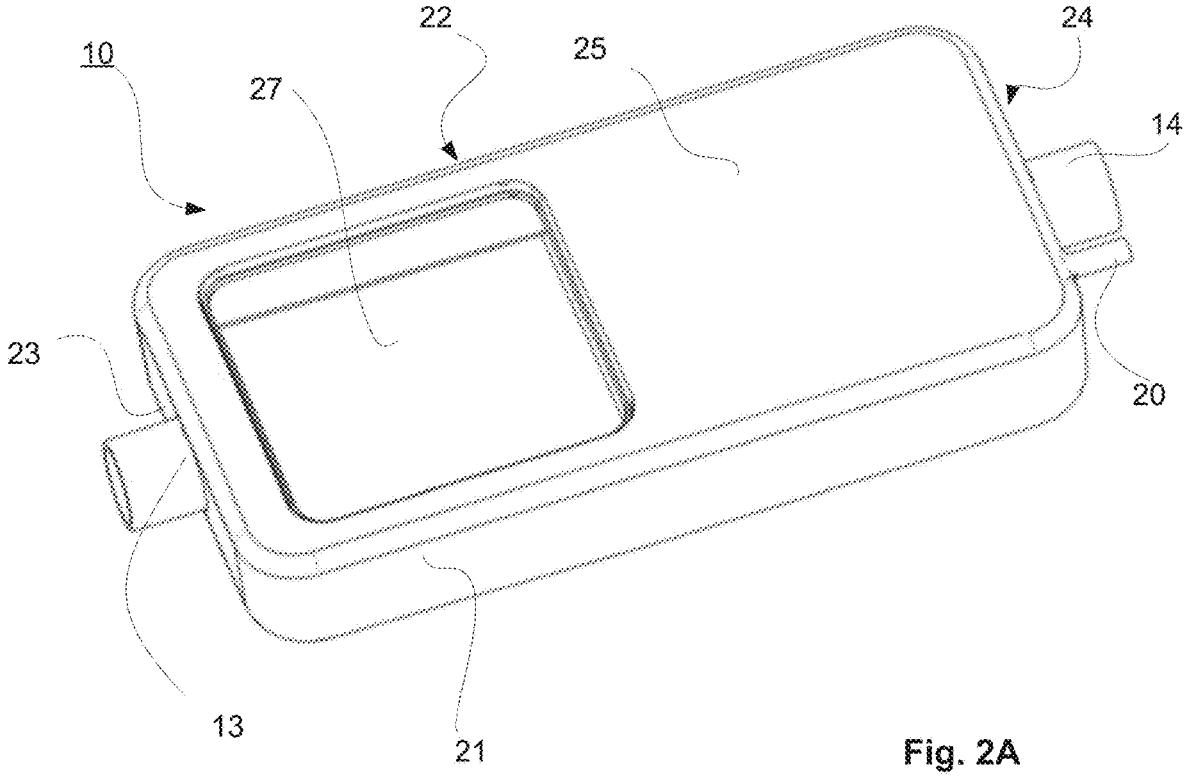
In FIGS. 2A-2B is schematically shown an advantageous example of outer frame structure of a buffer box according to the invention.
Figure 2B:
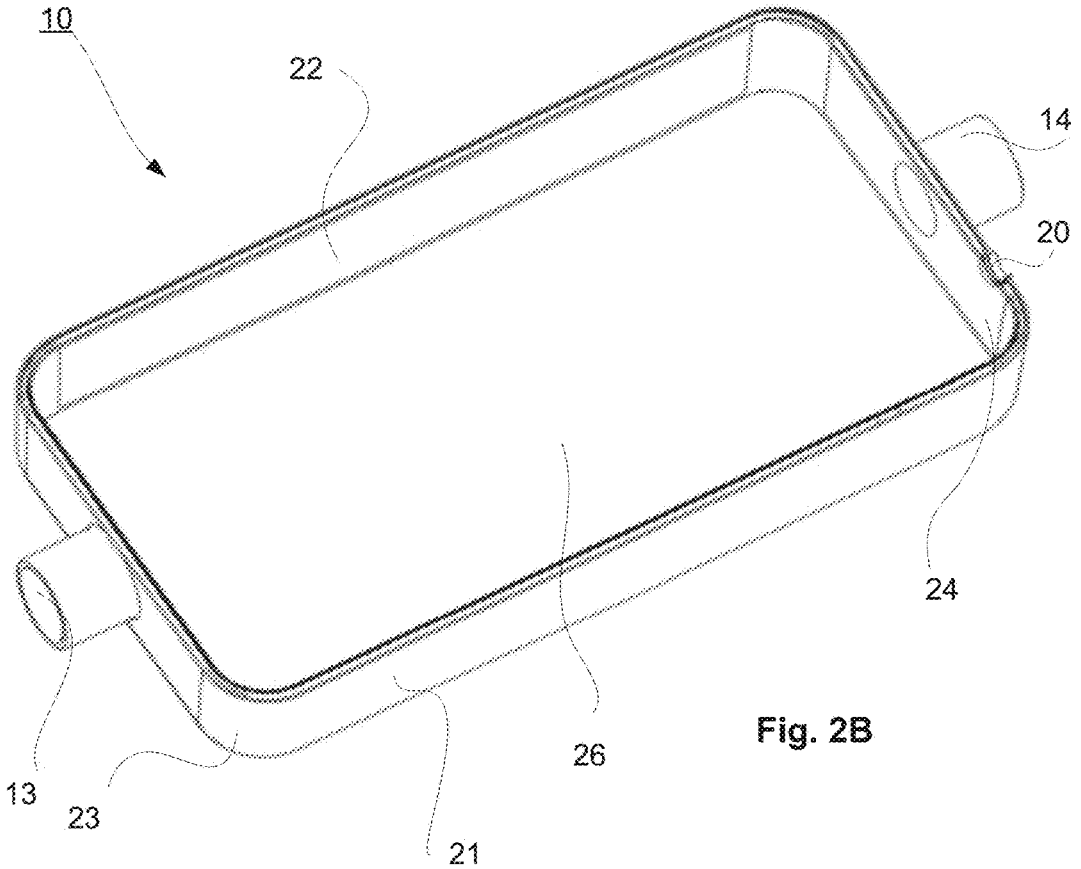
Figure 3A:
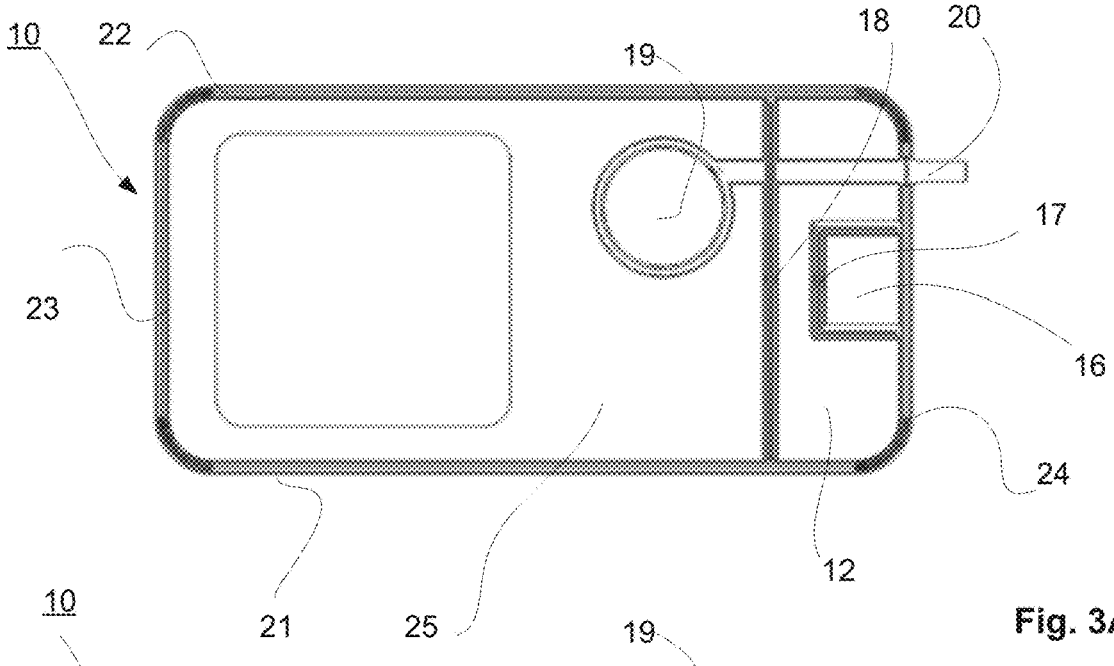
In FIGS. 3A-3C is schematically shown an advantageous example of inner structure of the advantageous example of the buffer box according to FIGS. 2A-2B.
Figure 3B:
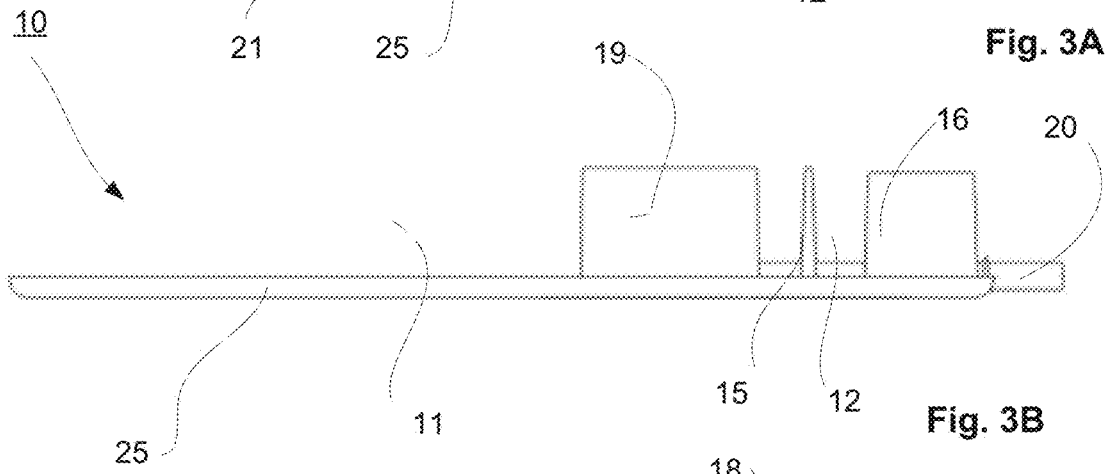
Figure 3C:
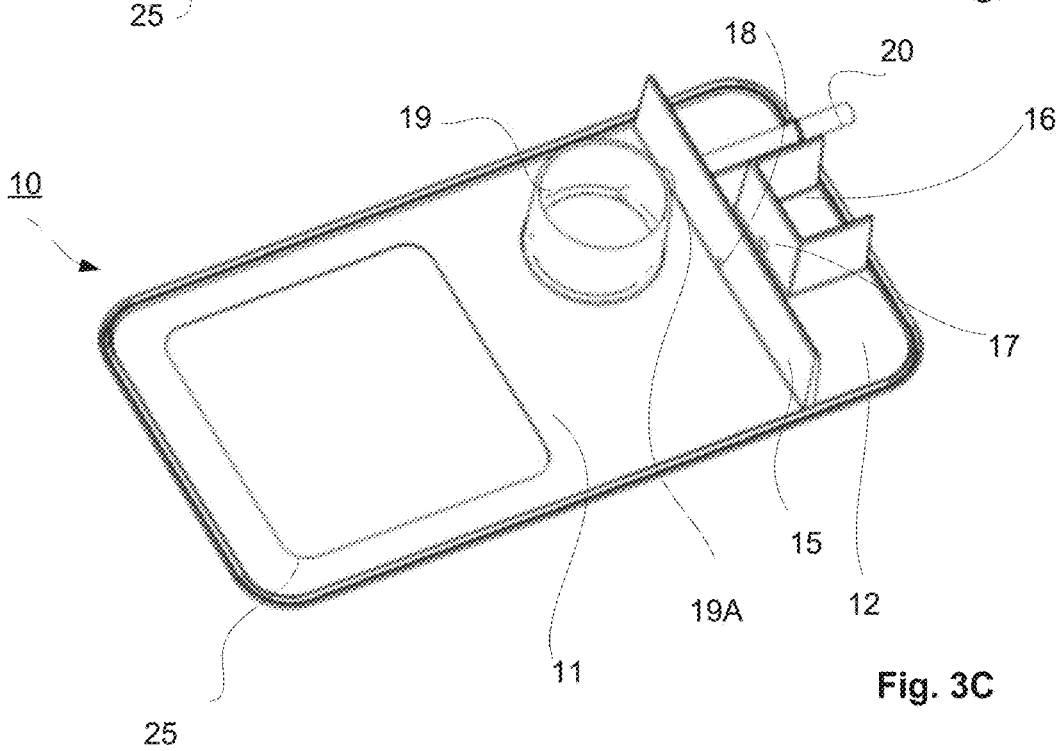
Figure 4A:
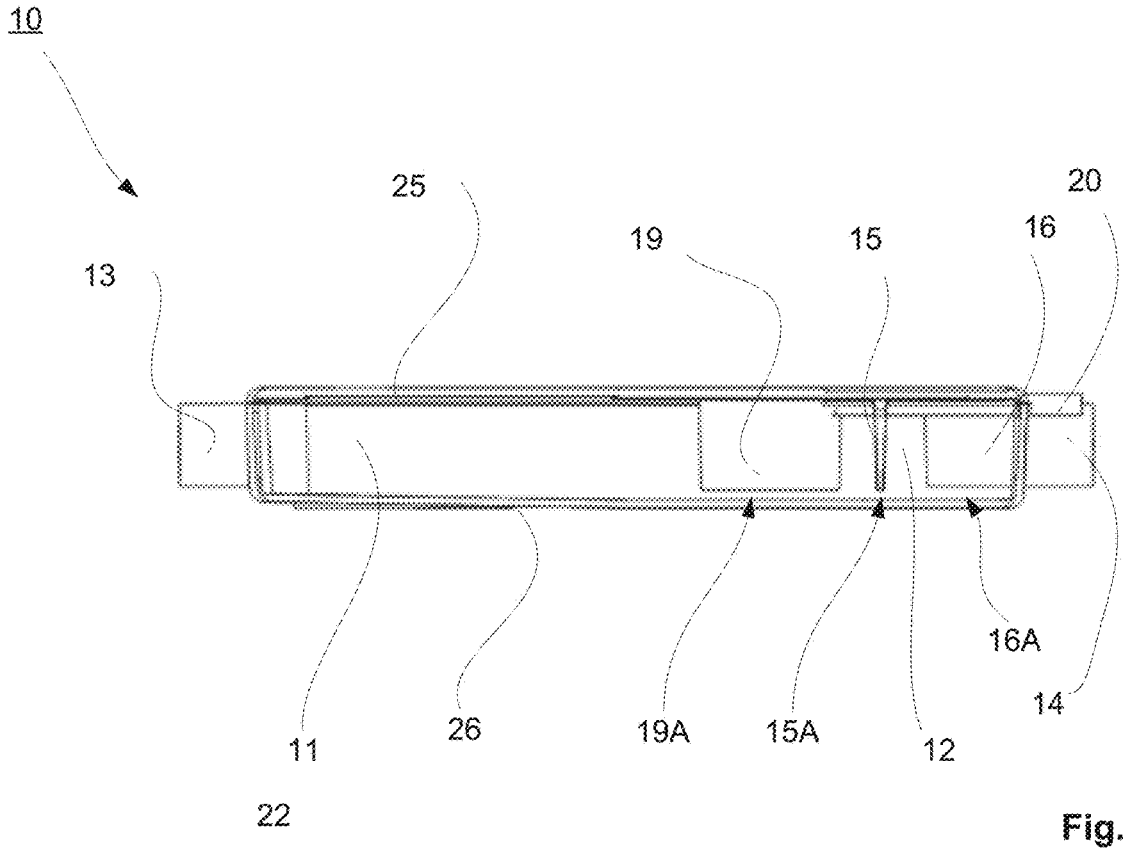
In FIGS. 4A-4B is schematically show another views of the advantageous example of the buffer box according to FIGS. 2A-3C.
Figure 4B:
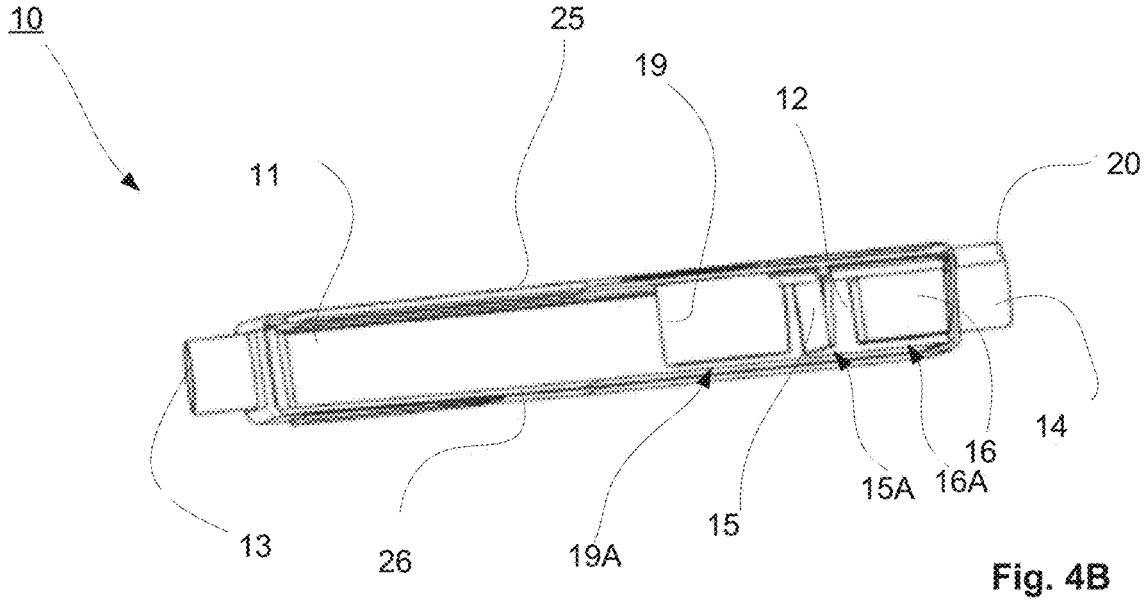

In FIG. 1 is shown an example of a vacuum drainage system 50 comprising a storage tank 40 and to the storage tank 40 connected a vacuum drainage piping 41, which is connected to at least one, in the example of the FIG. 1 two, collection branch 38, a pump 48 connected by the vacuum drainage piping 41 to the storage tank 40. In the example of the FIG. 1 the vacuum drainage system 50 comprises the storage tank 40 and the vacuum drainage piping 41 is connected to the storage tank 40, but alternatively the vacuum drainage system 50 may comprise a pump and the vacuum drainage piping 41 then is via the pump directly connected to a vacuum transport plumbing or directly to a drain to a sewer. Each of the collection branches 38 comprises a suction valve 42, which connects the respective collection branch 38 to the vacuum drainage piping 41. In normal operation stage the suction valves 42 are closed and the pump 48 creates negative pressure in the vacuum drainage piping 41. The collection branch 38 is thus at one end connected to the vacuum drainage piping 41 by the suction valve 42 and at the other end connected to outlet 14 of a buffer box 10. The buffer box 10 has an inlet 13 to which liquid, condensate from a temperature controlled cabinet for cool temperatures is directed. The vacuum drainage piping 41 also comprises a check valve 44 at a location before the vacuum drainage piping 41 connects to the storage tank 40. The storage tank 40 also comprises a drain 43 used for periodic discharge to a sewer drain.

In FIGS. 2A-4B is shown an example of the buffer box 10, comprising as an outer frame structure side walls 21, 22, end walls 23, 24, a top wall 25 and a bottom wall 26. The top wall 25 with the side walls 21, 22 and the end walls 23, 24 is constructed to form a cover frame structure of the buffer box 10 and the bottom wall 26 forms a bottom frame structure of the buffer box 10. The buffer box 10 comprises, as functional parts, a main compartment 11 and a suction compartment 12. Between the main compartment 11 and the suction compartment 12, as a dividing structure, a baffle 15 is located. The baffle 15 extends from the top wall 25 towards the bottom wall 26 but is located at a distance from the bottom wall 26 such that a baffle opening 15A is formed. Area of the baffle opening 15A exists in direct proportion to the flow area of the buffer box outlet 14 and width of the buffer box 10, advantageously the area of the baffle opening 15A is advantageously at a minimum 1:1 proportion to the buffer box outlet 14.

The buffer box 10 has at one end wall 23 an inlet 13 and at the other end wall 24 an outlet 14. The buffer box 10 in this example also comprises an alternate inlet 27, which also may function as vent and overflow. The alternate inlet 27 can be used for draining directly into the top of the buffer box 10 with the inlet 13 sealed, or it can be used in a plural configuration with drainage coming into both inlets simultaneously. The buffer box 10 also comprises a suction outlet 16 from the suction compartment 12 with a pre-aeration port 17, a suction chamber vent 18, a pneumatic head pressure chamber 19 and a head pressure port 20. The suction outlet 16 comprises a suction outlet opening 16A whose gap is set marginally higher than the baffle opening 15A in order to allow any material that passes the baffle opening 15A to pass through the buffer box outlet 14 and into the vacuum collection branch 38. Typically the suction outlet opening 16A is set slightly higher than the baffle opening 15A but advantageously is less than the minimum point of egress of the outlet 14. For example, if any debris gets into the suction compartment 12, it is passed through the suction outlet 16 and into the vacuum drainage piping 41. Advantageously, the opening of the pressure chamber 19 and the baffle opening 15A are set substantially identically to ensure the scouring action of the flow for cleaning purposes and for continuation of the flow into the suction outlet 16 via its opening 16A which is advantageously nominally higher. The buffer box 10 is low and the height of the buffer box 10 is sufficient to receive drainage as positioned underneath the temperature controlled cabinet, typically 50 mm or less, as dependent on the clearance from ground level to the drain of the temperature controlled cabinet. Advantageously, the buffer box 10 may have a height of 44.5-51 mm i.e. the distance between the outer surface of the bottom wall 26 and the outer surface of the top wall 25 is advantageously 44.5-51 mm. The pre-aeration port 17 is configured to allow a measured amount of air to the outlet 14 prior to the water from the main compartment 11 of the buffer box 10. This aeration rapidly clears standing water from the outlet 14 extending horizontal pipe part of the collection branch that connects the buffer box 10 to the vacuum drainage piping 41. This horizontal pipe part extending from the outlet 14 is typically up to 1 meter in length.

The suction compartment 12 is configured to accelerate the emptying of the main compartment 11 of the buffer box 10 and to efficiently remove surges of water as the air is removed from the suction compartment 12 through the pre-aeration port 17, a vacuum is created in the suction compartment 12, which vacuum creates a suction force along the baffle opening 15A from the main compartment 11 to the suction compartment 12. This produces an accelerated emptying of the main compartment 11 with a reduced air flow into the vacuum drainage system 50 as the baffle 15 prevents the air on top of the liquid to enter the suction compartment. The flow through the buffer box 10 keeps also the pneumatic head pressure chamber 19 i.e. the sensing chamber free of debris and helps to increase velocity of the flow under the baffle 15 i.e. in the baffle opening 15A to keep the buffer box 10 clean and clear of soft debris. The height of the baffle 15 as determined by the area of flow of the outlet 14 and width of the buffer box 10 is equivalent to the set height of the opening 19A of the pneumatic head pressure chamber 19. As the vacuum creates the suction force along the baffle opening 15A from the main compartment 11 to the suction compartment 12 and the accelerated emptying of the main compartment 11 with the reduced air flow into the vacuum drainage system 50 (FIG. 1) is provided for the accelerated emptying of the water. The buffer box 10 is configured to withstand sudden and sustained surge flows proportional to the buffer box capacity and outlet flow area. In one example of the buffer box 10 with a nominal holding capacity of up to 1 L, the buffer box 10 is configured to withstand a sudden and sustained surge flow of up to 30 LPM without overflowing. Thus, the configuration of the buffer box 10 allows for a high-flow rinse area around the opening of the pneumatic head pressure chamber 17 and across the inner surface of the bottom wall 26 of the buffer box 10. This flow of water across the bottom of the buffer box 10 provides a rinsing action across the bottom of the pneumatic head pressure chamber 19.

As shown in FIGS. 1-4C the vacuum drainage system 50 also comprises an activator 34 configured to control by means of operation of the suction valve 42 liquid level of the main compartment 11 of the buffer box 10. The vacuum drainage system 50 is provided with a sensor 36 connected to the head pressure port 20 of the buffer box 10. The sensor 36 monitors pressure level in the pneumatic head pressure chamber 19. The liquid in the main compartment 11 of the buffer box 10 closes off the bottom end of the pneumatic head pressure chamber 19 as the buffer box 10 fills with liquid and at the same air is trapped and compressed. Thus, during the liquid level raising, the pressure of the trapped air increases in the pneumatic head pressure chamber 19 and based on measured pressure level the liquid level in the main compartment 11 of the buffer box 10 can be determined. The activator 34 is also connected by a suction and valve line 37 to the valve 42 of the vacuum drainage piping 41 via the respective connect line 38. The valve 42 functions between open and closed positions by means of the negative pressure in the connect line 38 and in the vacuum drainage piping 41 when transported through the suction and valve line 37. Thus, based on the setting of the activator 34, when the set liquid level height is observed by the sensor 36, the activator 34 allows negative pressure to flow to the valve 42 as the valve 42 is opened. The liquid is transported via the outlet of the buffer box 10 to the collection branch 38 and to the vacuum drainage piping 41, when the liquid level in the main compartment of the buffer box 10 has reached the set liquid level by the sensor 36. The activator 34 opens the valve 42 and keeps it in open position for a preset time period. When the valve 42 is in open position, the negative pressure effects on the liquid in the buffer box 10. The atmospheric air over the liquid in the buffer box 10 creates a pressure difference via suction chamber vent 18 and pushes the liquid to the outlet 14 of the buffer box 10 and to the collection branch 38 and further to the vacuum drainage piping 41 and simultaneously the suction chamber vent 18. At the same time, air flowing through the pre aeration vent 17 occupies the buffer box 10. After a set time interval suction is closed by the valve 42. The vacuum drainage piping 41 directs the liquid to the storage tank 20, which is emptied at set time intervals via drain 43. The vacuum drainage piping 41 also comprises a check calve 44 to prevent back flow.

In the description in the foregoing, although some functions have been described with reference to certain features, those functions may be performable by other features whether described or not. Although features have been described with reference to certain embodiments or examples, those features may also be present in other embodiments or examples whether described or not. Above the invention has been described by referring to some advantageous examples only to which the invention is not to be narrowly limited. Many modifications and alterations are possible within the invention as defined in the following claims.

REFERENCE SIGNS USED IN THE DRAWING

10 buffer box
11 main compartment
12 suction compartment
13 inlet
14 outlet
15 baffle
15A baffle opening
16 suction outlet
16A suction outlet opening
17 pre-aeration port
18 suction chamber vent
19 pneumatic head pressure chamber
19A pneumatic head pressure chamber opening
20 head pressure port
21, 22 side wall
23, 24 end wall
25 top wall
26 bottom wall
27 alternate inlet
34 activator
36 sensor
37 suction and valve line
38 collection branch
40 storage tank
41 vacuum drainage piping
42 suction valve
43 drain
44 check valve
48 pump
50 vacuum drainage system

The invention claimed is:

1. A vacuum drainage system, which vacuum drainage system comprises: a vacuum drainage piping; a pump connected to the vacuum drainage piping and creating negative pressure in the vacuum drainage piping; and a buffer box comprising an outer frame structure having side walls, end walls, a top wall, a bottom wall, at least one inlet and outlet wherein the vacuum drainage piping is fluidly connected to the outlet to create negative pressure in the buffer box, wherein the buffer box comprises at least two compartments, which comprise a main compartment and a suction compartment with a suction outlet, between the main compartment and the suction compartment a baffle is located, the baffle extends from the top wall towards the bottom wall and is spaced from the end walls and located at a distance from the bottom wall such that a baffle opening is formed between the main compartment and the suction compartment, and the baffle prevents air on top of the liquid in the main compartment to enter the suction compartment.

2. The vacuum drainage system according to claim 1, wherein the height of the buffer box is sufficient to receive drainage as positioned underneath a temperature controlled cabinet, typically 50 mm or less, as dependent on the clearance from ground level to the drain of the temperature controlled cabinet.

3. The vacuum drainage system according to claim 1 wherein the suction compartment comprises a pre-aeration port allowing a measured amount of air to the outlet prior to liquid from the main compartment of the buffer box.

4. The vacuum drainage system according to claim 3 wherein the suction compartment accelerates emptying of the main compartment from therein collected liquid by removing air from the suction compartment through the pre-aeration port by creating a vacuum in the suction compartment by providing a suction force along the baffle opening from the main compartment to the suction compartment.

5. The vacuum drainage system according to claim 1 wherein area of the baffle opening exists in direct proportion to the flow area of the buffer box outlet and width of the buffer box, advantageously the area of the baffle opening is a minimum 1:1 proportion to the box outlet.

6. The vacuum drainage system according to claim 1 wherein the buffer box comprises a pneumatic head pressure chamber and that the flow from the main compartment to the suction compartment in the buffer box keeps the pneumatic head pressure chamber free of debris.

7. The vacuum drainage system according to claim 1 wherein the buffer box withstands sudden and sustained surge flows proportional to the buffer box capacity and outlet flow area.

8. The vacuum drainage system according to claim 1 wherein the buffer box further comprises a suction chamber vent.

9. The vacuum drainage system according to claim 1 wherein the buffer box further comprises a head pressure port.

10. The vacuum drainage system according to claim 1 comprising at least one collection branch connected to the vacuum drainage system and to the outlet of the buffer box.

11. The vacuum drainage system according to claim 10 each of the at least one collection branch comprises a suction valve.

* * * * *